US005792081A

United States Patent [19]

Cross

[11] Patent Number: 5,792,081

[45] Date of Patent: Aug. 11, 1998

[54] LIMB MASSAGER

[76] Inventor: Terry M. Cross, 1930 Granada Ave., San Diego, Calif. 92102

[21] Appl. No.: 544,714

[22] Filed: Oct. 18, 1995

[51] Int. Cl.[6] ..... A61H 15/00

[52] U.S. Cl. ..... 601/123; 601/125; 601/128; 601/129; 601/131; 601/133

[58] Field of Search ..... 601/112, 113, 601/115, 118–123, 125, 128, 129, 131, 133–137, 81, 71, 79, 111, 124, 132; 482/124, 88

[56] References Cited

U.S. PATENT DOCUMENTS

| | | | |
|---|---|---|---|
| 613,859 | 11/1898 | Hickey | 601/136 |
| 1,400,547 | 12/1921 | Holmstrom | 601/125 |
| 1,933,989 | 11/1933 | McCollough | 601/136 |
| 3,465,750 | 9/1969 | Schawalder | 601/122 |
| 3,504,665 | 4/1970 | Bakunin et al. | 601/71 |
| 3,856,002 | 12/1974 | Matsumoto | 128/67 |
| 4,191,177 | 3/1980 | Abbott | 601/125 |
| 5,195,510 | 3/1993 | Svacina | 128/61 |

FOREIGN PATENT DOCUMENTS

| | | | |
|---|---|---|---|
| 140735 | 2/1935 | Austria | 601/133 |
| 0346942B1 | 8/1984 | European Pat. Off. . | |
| 1149974 | 4/1985 | U.S.S.R. | 601/125 |
| 1528489 | 7/1986 | U.S.S.R. . | |
| 1711886A1 | 11/1988 | U.S.S.R. . | |
| 2990 | 8/1908 | United Kingdom | 601/133 |
| 2127297 | 4/1984 | United Kingdom . | |

*Primary Examiner*—Danton D. DeMille
*Attorney, Agent, or Firm*—Henri J. A. Charmasson; John D. Buchaca

[57] ABSTRACT

A self-operated apparatus particularly adapted for massaging a user's wrist and forearm affected by repetitive strain injuries such as carpal tunnel syndrome comprises two clamping arms hingedly joined at one end and provided with cooperating handles at the other ends. Rollers and balls are mounted on opposite median sections of the arms. The hinged ends of the arms are universally attached to a support that can be strapped over the user's thigh, whereby an arm can be adjustably clamped between the sets of rollers and balls by bringing the two handles together and the arm and wrist massaged by translating and rotating movements of the arm along an axis perpendicular to the mounting axes of the rollers and balls.

13 Claims, 2 Drawing Sheets

FIG. 6
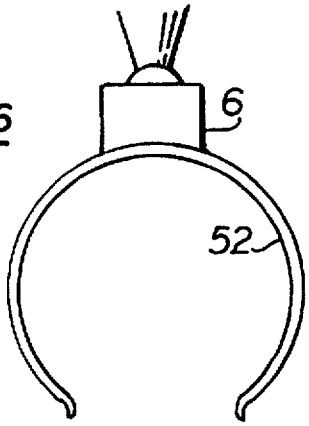
FIG. 7
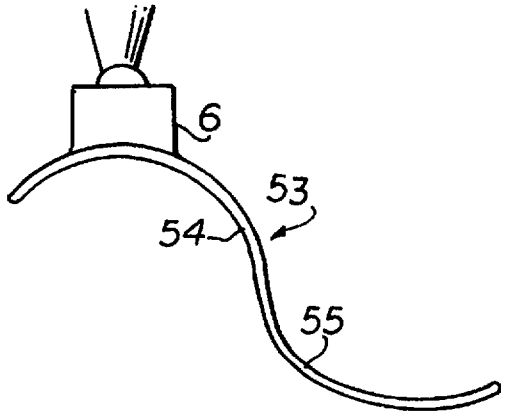
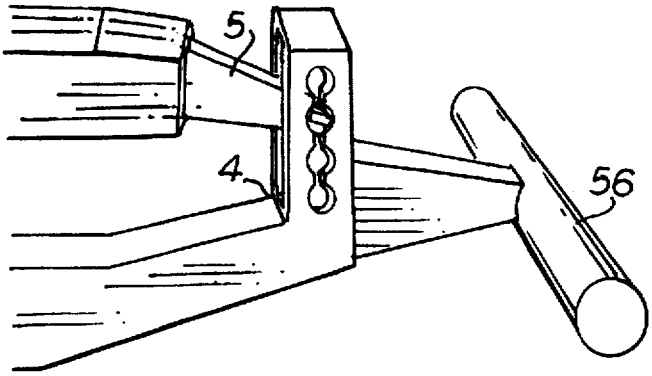
FIG. 8
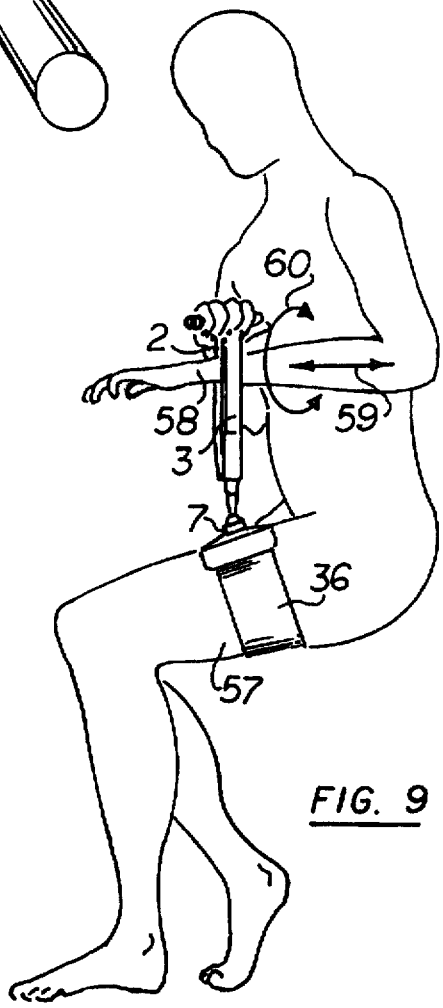
FIG. 9

LIMB MASSAGER

SUMMARY OF THE INVENTION

This invention relates to body massaging devices and more particularly to devices adapted for the treatment of wrists and arms affected by carpal tunnel syndrome.

BACKGROUND OF THE INVENTION

This invention is a result of a search for a self-operated massaging device for the preventive as well as remedial treatment of wrist and lower arm ailments.

Most self-operated massaging devices are hand-held massagers that do not provide for any stabilizing support and therefore cannot apply any substantial amount of controllable therapeutic pressure on the ailing muscle or tendon. Other automatic massaging devices driven by electric motors are not capable of reacting to a sudden pain felt by the user, and, therefore can inflict a great deal of unnecessary suffering before the user can turn off the device as the massaging heads reach a particular sensitive spot.

There is a need for a simple and inexpensive, yet effective limb-massager which although hand-operated can be firmly stabilized and applied under the user's own motions without risk of inflicting undue pain or discomfort.

SUMMARY OF THE INVENTION

The principal and secondary objects of this invention are to provide a hand-operated, limb-massaging instrument for the preventive or remedial treatment of muscular disorders and more specifically for the treatment of repetitive strain injuries such as carpal tunnel syndrome; in the form of a simple, yet efficient device that allows for stable and easily controllable application of rolling pressure to the affected area.

These and other valuable objects are achieved by a device consisting of two clamping arms hingedly joined about a support structure that can be secured to one of the user's thighs. Rollers installed in a face-to-face arrangement in median sections of the clamping arms can be adjustably brought to work against the lower arm and wrist while the free upper ends of the arms are held together with the user's free hand. The device compresses the limb from opposite sides to enhance blood and lymph circulation through muscle tissue. The relaxing effect on connective tissue allows for a greater range of muscular motion.

BRIEF DESCRIPTION OF THE DRAWINGS

FIG. 6 is a front view of a first alternate embodiment of the support base;

FIG. 7 is a front view of a second alternate embodiment of the support base;

FIG. 8 is a partial perspective view of a second embodiment of the limb-massaging apparatus; and FIG. 9 is an illustration of a limb-massaging method.

DESCRIPTION OF THE PREFERRED EMBODIMENTS OF THE INVENTION

Figure 1:
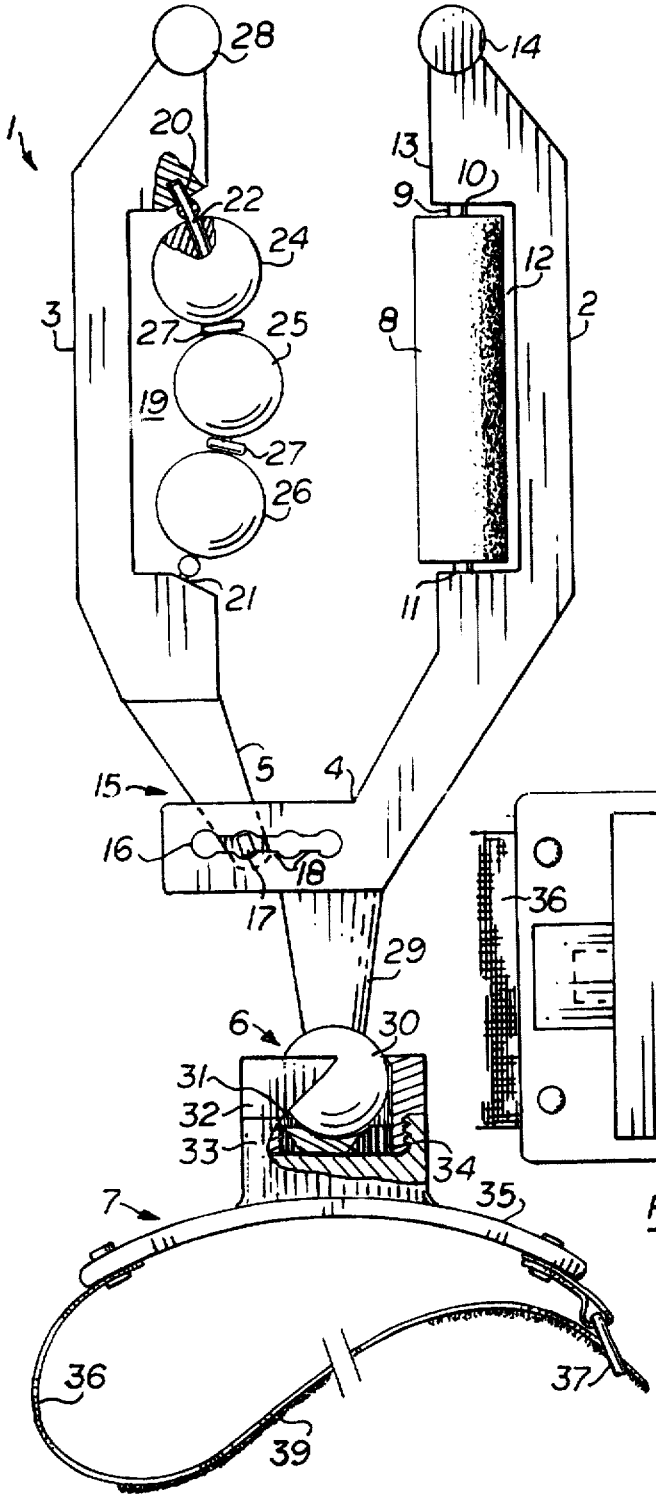
FIG. 1 is a front elevational view of the limb-massaging apparatus.
Figure 2:
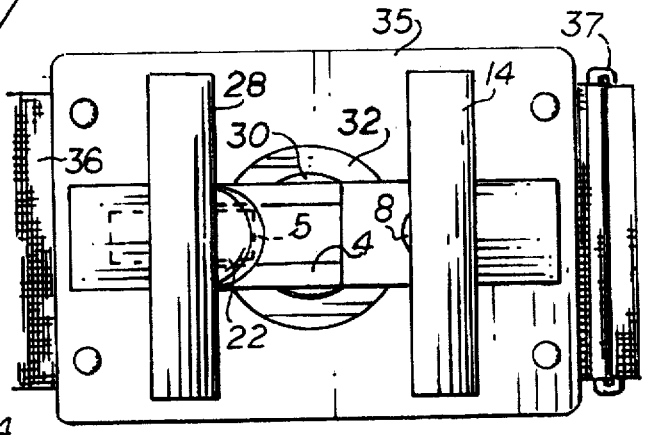
FIG. 2 is a top plan view thereof.

Referring now to the drawing, there is shown in FIGS. 1 and 2 a first embodiment 1 of a limb-massaging apparatus according to the invention. The apparatus comprises a first arm 2 and a second arm 3 hingedly connected at their lower ends 4 and 5. The lower end 4 of the first arm is also connected by a ball-and-socket assembly 6 to a support structure 7. The first arm 2 has a massaging member consisting of a roller 8 rotatively mounted on a median section of the first arm around a shaft 9 spanning two distant anchor points 10 and 11 bored into the side of a cutout section 12 in the inner side 13 of the first arm 2 facing the second arm 3. At the upper end of the first arm, a handle 14 is mounted perpendicularly to the arm and parallelly to the rotating axis of the second arm 3 in relation to the first arm. The lower end of the first arm defines an adjustable hinge 15 with the lower extremity 5 of the second arm 3. The hinge assembly 15 not unlike those found in adjustable pliers, provides a row 16 of four circular-bearing positions for the connecting pin 17 associated with the second arm. The pin 17 has been flattened on opposite sides so that it may be passed through the narrowed channels 18 connecting the circular-bearings. A cutout 19 in a median section of the second arm 3 facing the first arm, defines spaced-apart anchor points 20 and 21 for a resiliently flexible shaft 22 upon which are strung spherical rollers of balls 24–26 separated by bead-spacers 27. The resiliently flexible shaft 22 can be made from a section of piano cord, whalebone, or steel wire, preferably covered with a plastic sleeve for a smoother and quieter operation. The balls 24–26 and the roller 8 can be made of plastic or rubber with their surface preferably covered with a synthetic foam material for painless contact with the skin of the user. A second handle 28 symmetrical to the first handle 14 is mounted at the upper extremity of the second arm.

The ball-and-socket assembly joining the lower end 4 of the first arm to the support structure 7 comprises a conical tendon 29 welded to a ball 30, and a socket 31 having a first upper half 32 defining a cavity shaped and dimensioned to capture slightly more than one-half of the ball 30 and a lower half 33 screwed into the first half 32 and secured to the support structure 7. A resiliently compressible bearing 34 made of nylon, neopreme or other similar material is inserted between the two halves 32, 33 of the socket to provide limited friction between the ball 30 and the cavity of the socket 31.

The support structure 7 comprises an arcuate footing 35 shaped to rest comfortably on the leg of a user, and a strap 36 attached at one end to the arcuate footing 35 and engaging a ring 37 mounted at the opposite end of the arcuate footing 35. The strap has cooperating loops-and-vanes cloth fastening patches 38 and 39 so that it can be conveniently wrapped around a thigh of the user to secure the supporting structure 7.

Figure 3:
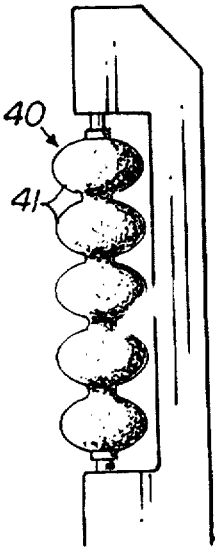
FIG. 3 is a side view of a first alternate embodiment of the massaging member.

It should be understood that the rollers forming one of the massaging members can have a variety of contact surface configurations such as the one 40 illustrated in FIG. 3 that comprises a plurality of bead-like formations 41.

Figure 4:
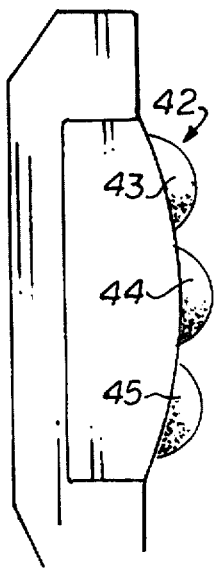
FIG. 4 is a side view of a second alternate embodiment of the massaging member.
Figure 5:
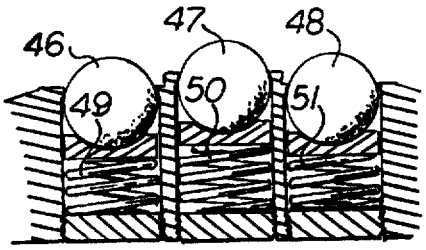
FIG. 5 is a cross-sectional view of the second alternate embodiment of the massaging member.

An alternate embodiment 42 of the spherical roller massaging member assembly 42 is illustrated in FIGS. 4 and 5. Instead of being strung on an arcuate flexible shaft, each spherical roller 43–45 is captured in its separate cavity 46–48 and backed by a coil-spring 49–51.

In lieu of the strap 36, a resilient circular clamp 52 may be used to secure the footing 7 as shown in FIG. 6 over the thigh of the user.

Another alternate embodiment of the support structure is shown in FIG. 7. In this case, the ball-and-socket assembly 6 is mounted on a generally S-shaped bracket 53 forming a first arch 54 shaped and dimensioned to rest on the upper portion of one of the user's thighs, and a second, inversely-oriented arch 55 shaped and dimensioned to be immobilized between the lower portion of the other thigh of the user and a sitting surface.

In an alternate embodiment of the limb-massaging apparatus shown in FIG. 8, the support structure has been replaced by a third handle 56 not unlike the first and second handles 14 and 28.

The limb-massaging apparatus is especially adapted for use by a patient on his own wrist and arm affected by carpal tunnel syndrome. FIG. 9 illustrates one way among many others of using the apparatus for such a purpose.

With the support structure 7 securely fastened around the hip 57 of the user, the wrist and arm 58 to be massaged can be captured between the two arms 2 and 3 at the level of their massaging members by the user grabbing with his free hand the two upper handles 14 and 28 and bringing them together until the massaging elements come into contact with the ailing wrist. The arm and wrist can then be moved in either a translating movement perpendicular to the axes of the massaging elements as indicated by arrow 59, or moved in a alternating rotating movement as indicated by arrow 60, or a combination of both types of motions. Due to the resilient mounting and surface coating of the massaging elements, the contact pressure against the ailing limb is automatically regulated. At all times the user remains in full control of the applied massaging pressure which he can release instantly upon sensing any pain or discomfort. This instant feedback offers a substantial advantage over automatic massaging devices.

The three-handle embodiment of the limb-massaging apparatus illustrated in FIG. 8 is particularly adapted for self-use on an ankle or calf. The user, in this case, translates the apparatus along the stationary limb by holding the lower handle 56 with one hand while adjustably holding the two upper handles 14 and 28 with the other hand.

While the preferred embodiments of the invention have been described, modifications can be made and other embodiments may be devised without departing from the spirit of the invention and the scope of the appended claims.

What is claimed is:

1. A limb-massaging apparatus which comprises:

a first arm having first and second ends;

a first massaging member rotatively mounted in a median section of said first arm;

a first handle mounted on said first end; and a holding structure secured to the second end of said first arm;

wherein said holding structure comprises:

a footing having an arcuate base; and a strap adjustably securable to opposite sides of said arcuate base and being sized to wrap around the leg of an operator.

2. The apparatus of claim 1, which further comprises:

means for articulately joining said footing to the second end of said first arm.

3. The apparatus of claim 2, wherein said means for articulately joining comprise a ball joint.

4. The apparatus of claim 1, which further comprises:

a second arm having first and second extremities;

a second handle mounted on said first extremity;

means for hingedly attaching said second extremity to the first arm;

a second massaging member mounted on a median section of said second arm; and wherein said first and second arms and said massaging members are shaped and dimensioned to adjustably clamp a limb between said first and second massaging members when said first and second handles are brought and held together.

5. The apparatus of claim 4, wherein one of said first and second massaging members comprises:

a resiliently flexible first shaft arcuately spanning two distant anchor points on one of said arms; and a plurality of rolling elements rotatively mounted on over said first shaft.

6. The apparatus of claim 5, wherein another of said first and second massaging members comprise:

a second shaft spanning two distant spaced-apart anchor points on another of said arms; and an elongated roller rotatively mounted on said second shaft.

7. The apparatus of claim 1, wherein said first massaging member comprises at least one spherical roller.

8. The apparatus of claim 1, wherein said first massaging member comprises:

at least one ball; and resiliently compressible means for rotatively mounting said ball.

9. The apparatus of claim 1, wherein said holding structure further comprises a third handle secured to said second end of said first arm.

10. A limb-massaging apparatus which comprises:

a first arm having first and second ends;

a first massaging member mounted in a median section of said first arm;

a first handle mounted on said first end;

a second arm having first and second extremities;

a second handle mounted on said first extremity;

means for hingedly attaching said second extremity to the first arm;

a second massaging member mounted on a median section of said second arm; and a holding structure secured to the second end of said first arm;

wherein said first and second arms and said massaging members are shaped and dimensioned to adjustably clamp a limb between said first and second massaging members when said first and second handles are brought and held together;

wherein said holding structure comprises:

a footing having an arcuate base;

a strap adjustably securable to opposite sides of said arcuate base and being sized to wrap around the thigh of an operator; and means for mounting the second end of said first arm on said footing.

11. The apparatus of claim 10, wherein said means for mounting comprise a ball joint.

12. A limb-massaging apparatus which comprises:

a first arm having first and second ends;

a first massaging member mounted in a median section of said first arm;

a first handle mounted on said first end;

a second arm having first and second extremities;

a second handle mounted on said first extremity;

means for hingedly attaching said second extremity to the first arm;

a second massaging member mounted on a median section of said second arm; and a holding structure secured to the second end of said first arm;

wherein said first and second arms and said massaging members are shaped and dimensioned to adjustably clamp a limb between said first and second massaging members when said first and second handles are brought and held together;

wherein said holding structure comprises:

a resilient clamp shaped to surround the thigh of an operator; and a ball-joint securing said clamp to the second end of said first arm.

13. A limb-massaging apparatus which comprises:

a first arm having first and second ends;

a first massaging member mounted in a median section of said first arm;

a first handle mounted on said first end;

a second arm having first and second extremities;

a second handle mounted on said first extremity;

means for hingedly attaching said second extremity to the first arm;

a second massaging member mounted on a median section of said second arm; and a holding structure secured to the second end of said first arm;

wherein said first and second arms and said massaging members are shaped and dimensioned to adjustably clamp a limb between said first and second massaging members when said first and second handles are brought and held together;

wherein said holding structure comprises:

an arcuate bracket generally S-shaped and dimensioned to wrap over a portion of a user's thigh and under another thigh; and, means for articulately joining said bracket to the second end of said first arm.

* * * * *